United States Patent [19]

Fessel

[11] 4,382,702

[45] May 10, 1983

[54] MEMORY TYPEWRITERS WITH INTERCHANGEABLE TYPING ELEMENT

[75] Inventor: Rudolf Fessel, Jever, Fed. Rep. of Germany

[73] Assignee: Olympia Werke AG, Wilhelmshaven, Fed. Rep. of Germany

[21] Appl. No.: 187,156

[22] Filed: Sep. 15, 1980

[30] Foreign Application Priority Data

Sep. 28, 1979 [DE] Fed. Rep. of Germany ..... 2939271

[51] Int. Cl.[3] ..... B41J 1/32

[52] U.S. Cl. ..... 400/144.2; 400/83; 400/175

[58] Field of Search ..... 400/8, 83, 144.2, 144.3, 400/149, 150, 151, 151.1, 171, 174, 175

[56] References Cited

U.S. PATENT DOCUMENTS

| | | | |
|---|---|---|---|
| 4,016,365 | 4/1977 | Staar | 400/83 X |
| 4,026,403 | 5/1977 | Inose et al. | 400/144.2 X |
| 4,074,798 | 2/1978 | Berger | 400/174 X |
| 4,208,140 | 6/1980 | Bucknam | 400/175 X |

OTHER PUBLICATIONS

IBM Technical Disclosure Bulletin, "Universal Control Providing a Variety of Character Fonts to Multiple CRT Displays", Boyd et al, vol. 21, No. 9, Feb. 1979, pp. 3479–3480.

IBM Technical Disclosure Bulletin, "Optimum Order of Print Wheel Selection in a Multi-Font Impact Printer," Moore et al, vol. 22, No. 5, Oct. 1979, pp. 1754–1755.

*Primary Examiner*—Ernest T. Wright, Jr.

*Attorney, Agent, or Firm*—Spencer & Kaye

[57] ABSTRACT

A word processing machine for printing text in the form of successive lines of characters on a record carrier and including a printing mechanism constructed to operate with interchangeable typing elements, each typing element carrying a selected set of type characters each corresponding to a respective character representation, a function keyboard for effecting input of first and second function instructions, input of the first instruction being effected when character representations are to be inputted which correspond to type characters carried by another typing element; and a control unit responsive to the first function instruction for temporarily preventing printing of characters corresponding to character representations subsequently inputted via a character input keyboard and for storing each character representation together with the first function instruction in the memory in a manner to indicate the intended location of the associated character on the record carrier, while causing the printing mechanism to leave a blank space at that intended location, and responsive to the second function instruction, after the other typing element is introduced into the printing mechanism, for causing readout from the memory of the character representations stored together with the first function instruction and printing of the associated characters at the respective intended locations on the record carrier.

7 Claims, 3 Drawing Figures

MEMORY TYPEWRITERS WITH INTERCHANGEABLE TYPING ELEMENT

BACKGROUND OF THE INVENTION

The present invention relates to a memory typewriter of the type having a character keyboard for selecting the characters to be typed, a function keyboard for supplying function instructions for the typewriter, a control unit, an operating memory and a printing mechanism arranged to hold interchangeable typing elements.

Memory typewriters have the capability of storing written-in text in the operating memory and of automatically printing it out from there, upon instruction, onto a record carrier, the entire sequence being controlled by the control unit of the typewriter. Machines operating with interchangeable typing elements, or type carriers, are capable of expanding the otherwise limited supply of characters on a single typing element since special characters or those used only infrequently can be arranged on one or more further typing elements. Thus, the keyboard and control for such a typewriter can be designed in such a manner that after a change of typing elements, the special characters are printed and stored. For this purpose, the normal keyboard may be used for example, after the actuation of a code key, indicating the typing element change, or an expanded keyboard may be provided.

Instead of a typing element with special characters, use may be made of an element which provides a different type of script so that the text on one record carrier can be reproduced with different types of script.

However, when utilizing this possibility in a memory typewriter, the advantage of being able to automatically print a text out of the memory is lost because the operator would have to change the element during the printing process—possibly several times. Moreover, the typing in of a text with simultaneous or delayed printout is complicated and time consuming because the operator must again exchange the typing element whenever characters are required that belong to a different element. For example, if within a brief which is to be printed in Roman letters, text portions are to appear in italics at six different places in the text, the operator would have to exchange the Roman script element for the italic script element six times and the latter again six times for the Roman script element.

SUMMARY OF THE INVENTION

It is an object of the present invention to simplify the operation of memory typewriters of the above-mentioned type for typing in characters disposed on different typing elements as well as for automatic printout of such characters stored in the operating memory of the typewriter.

This and other objects are accomplished according to the present invention, in a word processing machine for printing text in the form of successive lines of characters on a record carrier and including a character input keyboard for the input of character representations, a function keyboard for the input of function instructions, a control unit connected to receive the representations and instructions provided by the keyboards, an operating memory connected to the control unit, and a printing mechanism connected to be controlled by the control unit and constructed to operate with interchangeable typing elements, each typing element carrying a selected set of type characters each corresponding to a respective character representation, by providing the function keyboard with means for effecting input of first and second function instructions, input of the first instruction being effected when character representations are to be inputted which correspond to type characters carried by another typing element; and providing the control unit with means responsive to the first function instruction for temporarily preventing printing of characters corresponding to character representations subsequently inputted via the character input keyboard and for storing each character representation together with the first function instruction in the memory in a manner to indicate the intended location of the associated character on the record carrier, while causing the printing mechanism to leave a blank space at that intended location, and means responsive to the second function instruction, after the other typing element is introduced into the printing mechanism, for causing readout from the memory of the character representations stored together with the first function instruction and printing of the associated characters at the respective intended locations on the record carrier.

A significant advantage offered by the present invention is, in particular, that even with multiple changes in one text between characters disposed on different typing elements, two typing elements need be exchanged only a single time at the end of each record carrier page or at the end of a text. This considerably simplifies the work for the operator during character input, and automatic printout of such a text from the memory can take place without constant monitoring.

According to a preferred embodiment of the invention, the function keyboard is provided with means for effecting input of a plurality of sets of first and second instructions, with each set of instructions for a respectively different selected typing element. This makes it possible in an advantageous manner to use the sets of characters of more than two typing elements during input of a text and to automatically insert the characters belonging to this set of characters into the gaps in the prepared text by actuating a key after exchange of typing elements. This considerably increases the versatility of such a typewriter without requiring complicated manipulations.

According to another preferred embodiment of the invention, the machine is arranged to operate with three or more of such typing elements, with each typing element being associated with a first function instruction with at least one such element being provided with a symbol that can be sensed by the machine when that typing element is introduced into the machanism and that identifies that element, and the control unit is arranged to sense such symbol and the inputting of the second function instruction for causing readout from the memory of the stored character representations identified by the first function instruction associated with that element. This offers the advantage that the machine automatically recognizes the type of characters contained in a set when the typing element is inserted and will be able to automatically cause only the characters on this element to be read out of the memory without any further action by the operator to print these characters. This measure makes it impossible for the operator to inadvertently actuate a function key which does not belong to the typing element inserted and which would result in a wrong character being printed.

DESCRIPTION OF THE PREFERRED EMBODIMENTS

Figure 1:
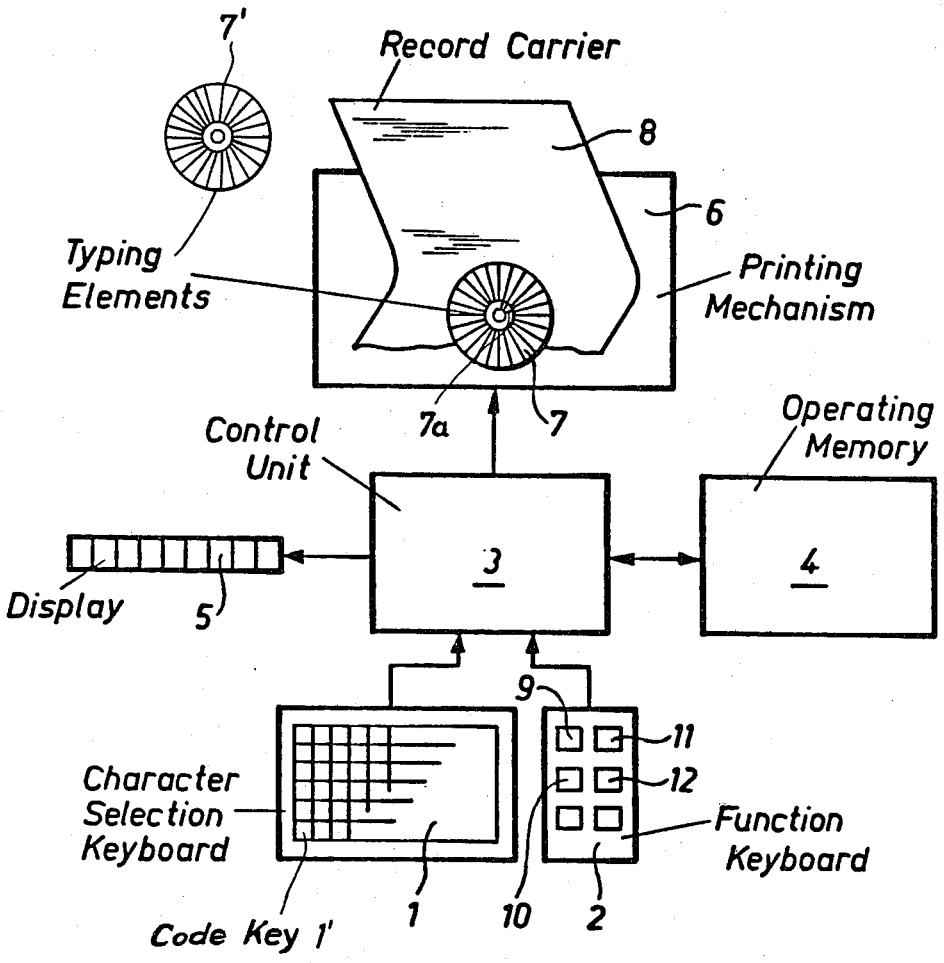
FIG. 1 is a block diagram of a preferred embodiment of the invention.

FIG. 1 illustrates those parts of a memory typewriter which are required for an explanation of the present invention. These include a character selecting keyboard 1, a function keyboard 2, a control unit 3 constituted, for example, by a microcomputer, an operating memory 4, a character display 5, and a printing mechanism 6 which includes a typing element 7 in the form of a daisy wheel. A set of characters is disposed on typing element 7 and each of these characters can be printed on a record carrier 8. Moreover, the typing element 7 can be removed from the machine by the operator and replaced by another typing element 7' carrying a different set of characters, e.g. a different type of script, characters of a different language or special characters.

It may occur that the operator must print a text on the record carrier 8 requiring essentially a typing element 7 carrying the Roman script type, but at various places in the text, portions are to appear in italics and at other places special mathematical symbols are required. However, the characters in italic script are disposed on a different, second typing element and the special mathematical symbols are disposed on a further, third typing element.

The operator begins to type in the characters of the text with the aid of the character keyboard 1 and the control unit 3 takes care that the codes of the actuated keys are stored in the operating memory 4 in their proper positions. At the same time the characters are displayed on a character display 5, starting in the extreme right-hand location of the display 5 and shifting one location to the left with every further character input. By this procedure, the operator is able to check the typed characters for accuracy and, in the case of an error, make a correction before printout by means known for the correction of characters in memory typewriters having a character display. Once the character display 5 is filled, the control unit 3 causes each further character typed in to cause the character displayed in the extreme left-hand location to be pushed out of the display 5 and to be printed on the record carrier 8 by the typing element 7 of the printing mechanism 6.

Since the text is to be printed essentially in Roman script, the operator will have initially inserted the typing element 7 therefor into the machine. When the first text portion to be printed in italics is reached, the operator actuates a function key 9 to put in a first function instruction "DON'T PRINT", whereupon the key code of every subsequently actuated key in the character keyboard 1 is provided with an identification code corresponding to that of the actuated function key 9, which is then stored in the operating memory 4 in its proper position. Although corresponding characters are displayed on the display 5, no printing function is performed when they leave the display 5. The printing mechanism 6 merely executes a spacing step so that a space appears in the printed text on the record carrier 8 for each such character.

Renewed actuation of the function key 9 "DON'T PRINT" cancels the function instruction so that the further text typed in is again stored without any additional code and will be printed in the Roman script of the inserted typing element 7.

If during the typing of the text it becomes necessary to use the special mathematical symbols whose types—as explained above—are disposed on a third typing element, the operator again actuates a first function instruction "DON'T PRINT". For this purpose, the operator depresses a function key 10 different from the key 9 which was used for the text portions to be printed in italics, whereupon the key codes of all subsequently actuated keys on the character keyboard 1 are provided with an identification code associated with the function key 10 and are stored in the proper position in operating memory 4. Thus the operating memory 4 contains key codes for special mathematical symbols which are identified by a different identification code than the key codes for the characters to be printed in italics while the characters to be printed in Roman script, which are already printed on the record carrier 8 in the machine are stored in the memory 4 without any identification code.

The special mathematical symbols are also shown on the display 5 but are not printed. The printing mechanism 6 merely performs a space step per key actuated. Renewed actuation of the function key 10 then results in a return to the normal mode of operation.

If the typing of the text is completed, the text on the record carrier 8 will have gaps where those characters whose printing types are not available on the inserted typing element 7 should go. The operator now replaces the typing element 7 with the Roman script by another typing element 7' carrying italic script and actuates a further function key 11 to put in a second function instruction "READOUT AND PRINT". The control 3 then causes all those key codes to be read out which are provided with the identification code of function key 9, causes the italic typing element 7' to be brought to the correct position with respect to the record carrier 8 and to be set to the character to be printed, which is then printed. This sequence takes place automatically, the italic insertions being made in sequence from the end of the text to the beginning, or vice versa. In the latter case the operator must first set the record carrier 8 to the start of the text.

Once the portions of the text to be printed in italics have been printed, the italic typing element 7' is replaced by the third element provided with the special mathematical symbols. Actuation of another function key 12 to put in the second function instruction "READOUT AND PRINT" causes readout from the operating memory 4 of all key codes which during input were provided, by depression of that key 10, with the identification code associated with key 10, and printout takes place in the above-described manner. Further function keys for the first and second function instructions permit the use of further typing elements in the same text.

Printout on the record carrier 8 is now completed. Even if the text required many changes from Roman script to italics or special symbols, the operator needed to insert each typing element only once. Even with repeated readout of the entire text from the operating memory 4 and printing on further record carriers 8, the procedure continues in the above-described manner so that then again each typing element need be used only once.

In a departure from the special embodiment described above, other embodiments are possible, for example, a different way of putting in the first and second function instructions, possibly by using the keys of the character keyboard 1 in conjunction with a code key 1' in such a manner that actuation of the code key 1' and a character key puts in a first function instruction, actuation of the code key 1' and a second character key puts in a second function instruction, etc.

Separate memory regions may also be provided for the portions of the text identified in the operating memory 4 by an identification code, with these text portions being stored in the special regions so that the association of a special code with each character would not be necessary and only the corresponding memory region would be addressed.

Alternatively, each typing element 7 or 7' could be provided with a symbol *7a* which is scanned by the memory typewriter and which identifies the particular set of characters on this typing element. With such a symbol *7a*, the control unit 3 would be able to read out from the operating memory 4 without special instruction from the operator, after a second function instruction "READOUT AND PRINT", only those characters which are provided on the inserted typing element. Such an arrangement which is suitable for the present purpose is disclosed in application Ser. No. 96,376, filed Nov. 21, 1979, Kittel et al, now abandoned in favor of continuing application Ser. No. 296,485 filed Aug. 26, 1981, assigned to the assignee of this application.

A known word processing machine, which could be modified and programmed to operate in accordance with the present invention is the commercially available text processing system 6110, manufactured by Olympia Werke AG, Wilhelmshaven, Federal Republic of Germany.

Figure 2:
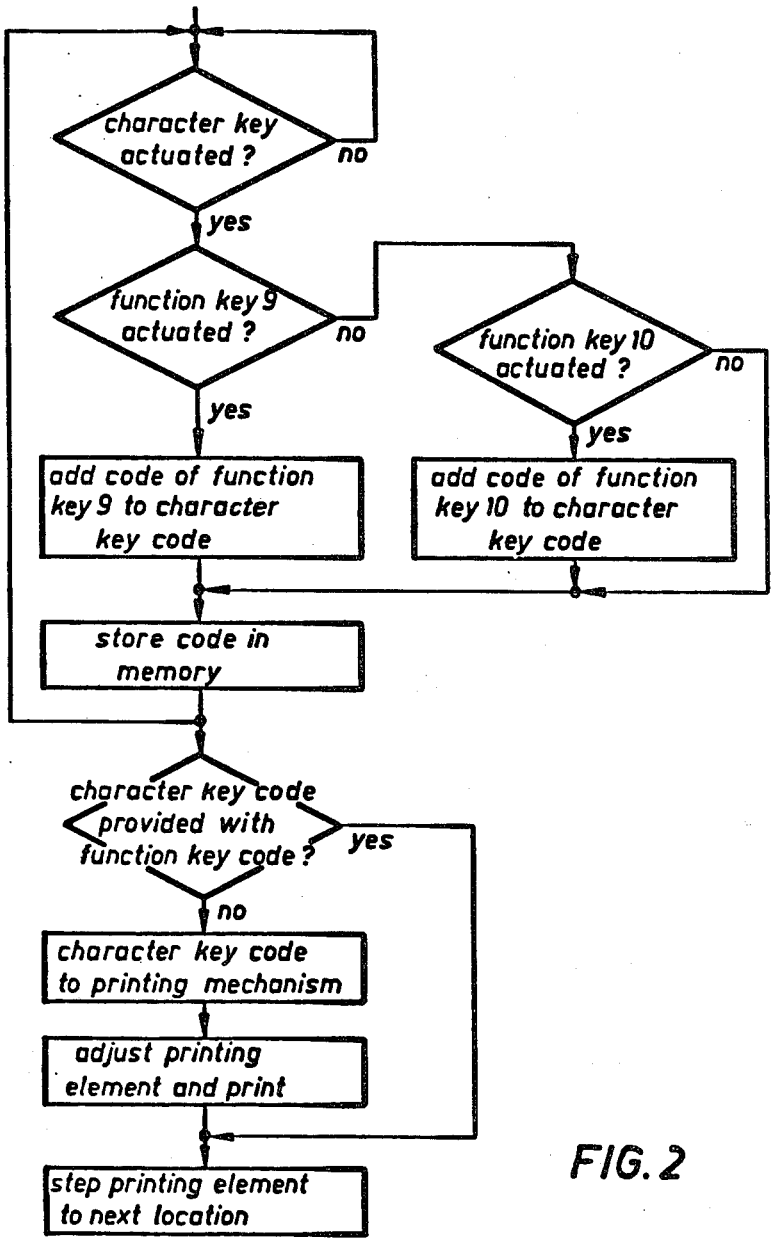
FIGS. 2 and 3 are simplified flow diagrams illustrating operations of an embodiment of the invention.

The flow diagram of FIG. 2 shows in a simplified way the operation of control unit 3 of an embodiment without a character display. Only those functions are shown that are helpful for an understanding of the invention. A continuous program request takes place whether a character key has been actuated or not. If a character key has been actuated, a request takes place whether the function key 9 or—if not—the function key 10 has been actuated. If none of these function keys 9, 10 have been depressed the code of the actuated character key is stored in the memory 4. The program begins again with the question "character key actuated?".

Out from the memory 4—that functions as a buffer between the typing in of characters and the possibly slower printing out—the code is taken for a request whether it is provided with an identification code of a function key 9, 10. If not, the code is transferred to the printing mechanism 6, the printing element 7 is adjusted, the character is printed and the printing element 7 is stepped forward to the next printing location.

If on the other hand one of the two function keys 9 or 10 has been actuated, the identification code of the respective function key is added to the code of the actuated character key and both are stored in the memory 4. The following request "character key code provided with function key code?" will be answered with "yes" whereupon the printing element 7 will be stepped forward to the next printing position without any character being printed.

Figure 3:
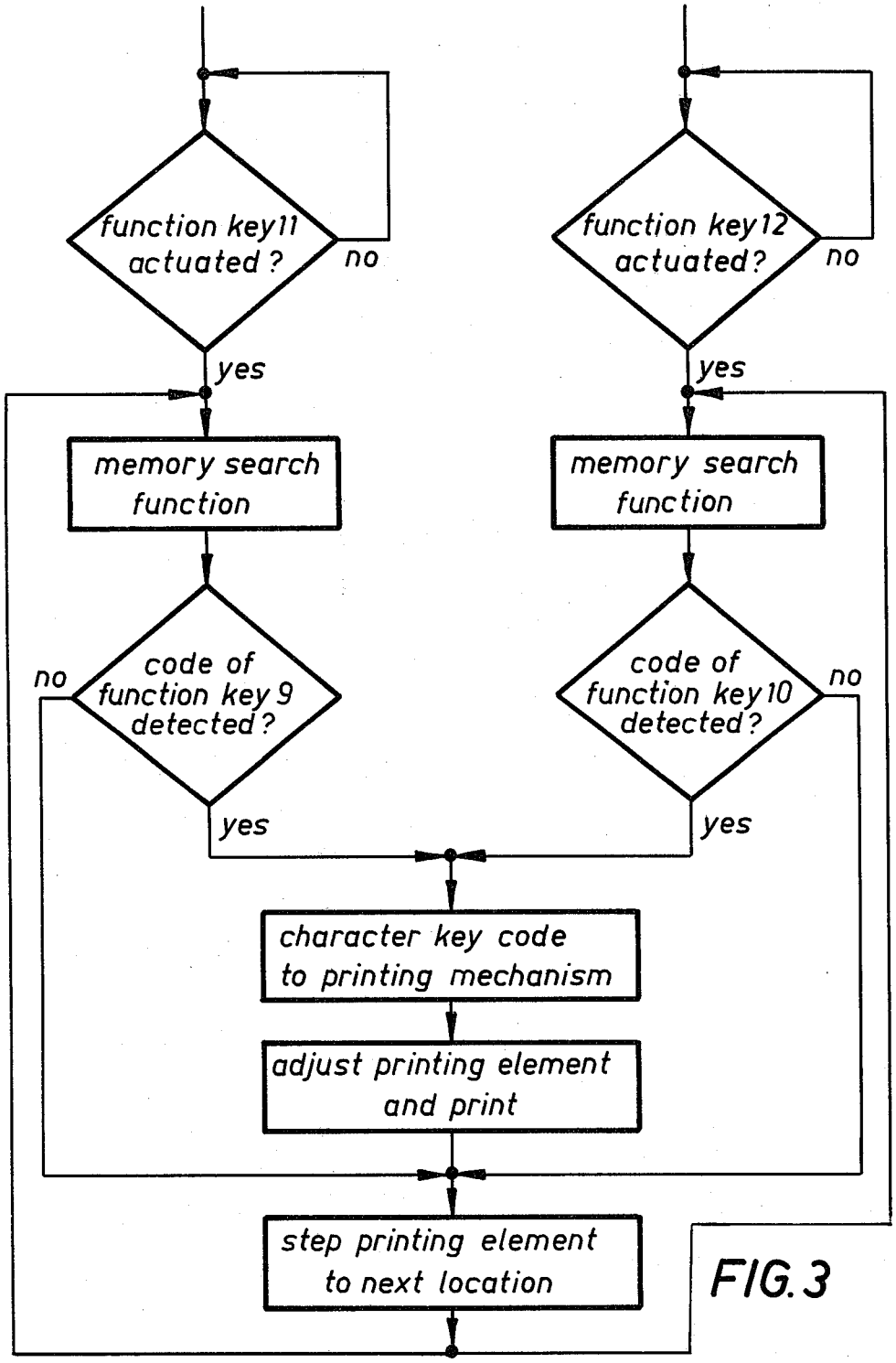

When the text on the record carrier 8 has been printed but has gaps where those characters should be inserted whose printing types are available on another typing element 7', the operator changes the typing element 7 an positions the record carrier 8 to the start of the text. The simplified flow diagram of FIG. 3 illustrates the now following operation of control unit 3.

The program request whether function key 11 or 12 has been actuated is repeated until the answer for one of the two keys is "yes". Now a memory search function takes place until a character key code which is provided with the identification code of function key 9 or 10 respectively is detected. The character key code is transferred to the printing mechanism 6, the printing element 7' is adjusted, the character is printed and the printing element 7' is stepped forward to the next printing location. Then the next memory search function takes place. Whenever the question "identification code detected?" is answered with "no" only the stepping function is actuated and the next memory search function takes place.

It will be understood that the above description of the present invention is susceptible to various modifications, changes and adaptations, and the same are intended to be comprehended within the meaning and range of equivalents of the appended claims.

What is claimed is:

1. In a word processing machine for printing text in the form of successive lines of characters on a record carrier and including a character input keyboard for the input of character representations, means including at least one further key for the input of function instructions, a control unit connected to receive the representations and instructions provided by the keyboard and the means for the input of function instructions, an operating memory connected to the control unit, and a printing mechanism connected to be controlled by the control unit and constructed to operate with interchangeable typing elements, each typing element carrying a selected set of type characters each corresponding to a respective character representation, the improvement wherein: said means for the input of function instructions comprises means for effecting input of first function and second function instructions, input of the first instruction being effected when character representations are to be inputted which correspond to type characters carried by another typing element; and said control unit is responsive to the first function instruction for temporarily preventing printing of characters corresponding to character representations subsequently inputted via said character input keyboard and for storing each character representation together with the first function instruction and in a manner to indicate the intended location of the associated character on the record carrier, while causing said printing mechanism to leave a blank space at that intended location, and is responsive to the second function instruction, after said other typing element is introduced into said printing mechanism, for causing readout from said memory of the character representations stored together with the first function instruction and printing of the associated characters at the respective intended locations on the record carrier.

2. An arrangement as defined in claim 1 wherein said means for the input of function instructions comprises means for effecting input of a plurality of sets of first and second instructions, with each set of first and second instructions for a respectively different selected typing element.

3. An arrangement as defined in claim 1 or 2 wherein said means for effecting input comprise function keys mounted in a function keyboard.

4. An arrangement as defined in claim 1 or 2 in combination with a plurality of such typing elements, with each typing element being associated with a first function instruction, with at least one typing element being provided with a symbol that can be sensed by said machine when said at least one typing element is introduced into said printing mechanism and that indentifies said at least one typing element, and wherein said control unit is responsive to sensing of said symbol and to inputting of the second function instruction for causing readout from said memory of the stored character representations identified by said first function instruction associated with said at least one typing element.

5. An arrangement as defined in claim 4 wherein said machine further comprises a display device capable of displaying all available characters and connected to said control unit for displaying at least those characters which are temporarily not printed as a result of introduction of a first function instruction.

6. An arrangement as defined in claim 1 or 2 further comprising a display device capable of displaying all available characters and connected to said control unit for displaying at least those characters which are temporarily not printed as a result of introduction of a first function instruction.

7. A method for printing text in the form of lines of characters contained on two different typing elements on a record carrier in a word processing machine including a character input keyboard for the input of character representations, means for the input of function instructions, a control unit connected to receive the representations and instructions provided by the keyboard and the means for the input of function instructions, an operating memory connected to the control unit, and a printing mechanism connected to be controlled by the control unit and constructed to operate interchangeably with either typing element, each typing element carrying a selected set of type characters each corresponding to a respective character representation, comprising:

inserting one of the typing elements in the printing mechanism and actuating the character input keyboard for effecting input of characters to be printed, and printing of characters contained on the one typing element;

prior to input of characters contained on the other typing element, actuating the means for the input of function instructions for effecting input to the control unit of a first function instruction and then actuating the character input keyboard for effecting input of the characters contained on the other typing element in order to store each associated character representation together with the first function instruction in the memory in a manner to indicate the intended location of the associated character on the record carrier, while temporarily preventing printing of characters and causing the printing mechanism to leave a blank space at each such intended location;

after effecting input of a complete text portion containing at least one character contained on the other typing element, replacing the one typing element by the other typing element and then actuating the means for the input of function instructions for effecting input to the control unit of a second function instruction in order to cause readout from the memory of the character representations stored together with the first function instruction and printing of the associated characters at the respective intended locations on the record carrier.

* * * * *